United States Patent [19]

Seissl et al.

[11] 4,238,681

[45] Dec. 9, 1980

[54] X-RAY DIAGNOSTIC GENERATOR

[75] Inventors: Johann Seissl; Karlheinz Broenner; Hartmut Krause, all of Erlangen, Fed. Rep. of Germany

[73] Assignee: Siemens Aktiengesellschaft, Berlin & Munich, Fed. Rep. of Germany

[21] Appl. No.: 80,042

[22] Filed: Sep. 28, 1979

[30] Foreign Application Priority Data

Oct. 2, 1978 [DE] Fed. Rep. of Germany ..... 2842947

[51] Int. Cl.[3] ..... H05G 1/30

[52] U.S. Cl. ..... 250/402; 250/408; 250/421

[58] Field of Search ..... 250/401, 402, 408, 409, 250/421

[56] References Cited

U.S. PATENT DOCUMENTS 3,846,633 11/1974 Romandi ..... 250/402

4,063,099 12/1977 Grassme ..... 250/402

*Primary Examiner*—Craig E. Church

*Attorney, Agent, or Firm*—Hill, Van Santen, Steadman, Chiara & Simpson

[57] ABSTRACT

In an exemplary embodiment, a bridge rectifier is coupled with the primary circuit of the high voltage transformer. In the d.c. current branch of the bridge rectifier, a smoothing capacitor and a thyristor are arranged. The thyristor is turned on and off with a pulse duty cycle which determines the capacitor voltage and hence the x-ray tube voltage. At the thyristor, an LC-oscillatory circuit is connected whose capacitance when the thyristor is conductive, is discharged via the latter and which effects the extinction of the thyristor via a free-running diode which is conductive in return oscillation phase and which is disposed parallel to the thyristor. In this manner, a high switching frequency of the thyristor and hence a minimal ripple of the x-ray tube voltage can be achieved.

2 Claims, 1 Drawing Figure

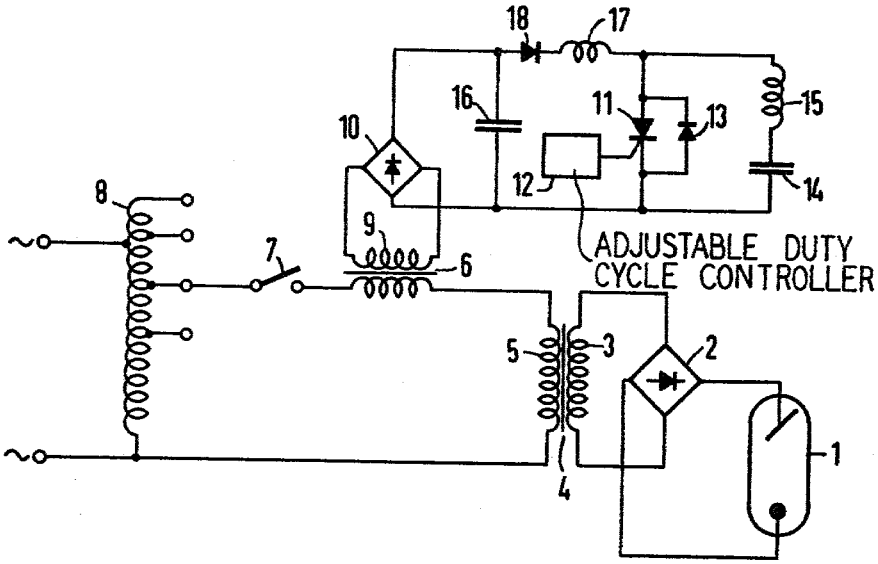
18
17
16
11
13
15
10
12
14
8
9
7
6
ADJUSTABLE DUTY
CYCLE CONTROLLER
5
3
2
1
4

X-RAY DIAGNOSTIC GENERATOR

BACKGROUND OF THE INVENTION

The invention relates to an x-ray diagnostic generator comprising a high voltage transformer with at least one primary winding connected to the mains, and at least one secondary winding which feeds the x-ray tube, as well as comprising a bridge rectifier coupled with the primary circuit of the high voltage transformer to which a capacitor and a thyristor are connected, the thyristor being operated at a frequency and with a pulse duty cycle which correspond to the desired x-ray tube voltage.

An x-ray diagnostic generator of this type is described in the German Offenlegungsschrift No. 2,258,085. In the case of this x-ray diagnostic generator, the adjustment, or regulation, respectively, of the x-ray tube voltage proceeds in the low voltage circuit, on the one hand, so that no high voltage rated components are necessary; and a particularly rapid adaptation (or matching) of the x-ray tube voltage to a desired value takes place, on the other hand. The ripple of the high voltage at the x-ray tube is dependent upon the switching frequency of the thyristor and upon the size of the smoothing (or filter) capacitor. The higher the switching frequency, the lesser the ripple.

SUMMARY OF THE INVENTION

The object underlying the invention consists in developing an x-ray diagnostic generator of the type initially cited such that the thyristor can be operated with a very high switching frequency so that the ripple of the x-ray tube voltage is extremely minimal, while involving a small capacitor outlay.

In accordance with the invention, this object is achieved by virtue of the fact that there is connected to the thyristor an LC-oscillatory circuit whose capacitor, when the thyristor is conductive, discharges itself via the latter, and which effects the extinguishing of the thyristor via a free-running diode disposed parallel to the thyristor, the diode being conductive in the return oscillatory phase. In the case of the inventive x-ray diagnostic generator, the thyristor is ignited by a brief ignition pulse from a control circuit. The smoothing capacitor discharges itself by a small amount, and the extinction (or quenching) capacitor is recharged. In the return oscillatory phase, the thyristor is extinguished due to the voltage of the LC-oscillatory circuit acting counter to the thyristor voltage. A switch-on time of the thyristor is thus determined by the duration of the oscillatory cycle of the LC-oscillatory circuit.

Details of the invention are apparent from the subclaims.

The invention shall be explained in greater detail in the following on the basis of the exemplary embodiment illustrated on the accompanying sheet of drawing; and other objects, features and advantages will be apparent from this detailed disclosure and from the appended claims.

BRIEF DESCRIPTION OF THE DRAWING

The single FIGURE is an electric circuit diagram for illustrating an embodiment in accordance with the invention.

DETAILED DESCRIPTION

In the drawing, an x-ray tube 1 is illustrated which is supplied via a high voltage rectifier 2 by the secondary winding 3 of a high voltage transformer 4. The primary winding 5 of the high voltage transformer 4 is connected, via a transformer 6 and a main switch 7, to an auto-transformer 8 which serves the purpose of coarse adjustment of the voltage at x-ray tube 1.

For fine adjustment of the x-ray tube high voltage, there is connected to the secondary winding 9 of the transformer 6, a rectifier 10 in whose d.c. current branch a capacitor 16 and a thyristor 11 are disposed, the thyristor periodically receiving turn-on pulses from a control circuit 12. A free-running diode 13 is connected parallel to the thyristor 11. In addition, there is disposed, parallel to the thyristor 11 and to the free-running diode 13, and LC-oscillatory circuit 14, 15. An inductance 17 limits the rate of the buildup of the discharge current from the capacitor 16, such that, with the LC-oscillatory circuit 14, 15, the thyristor 11 can be extinguished. A diode 18 prevents an oscillation, caused by the series connection of the capacitors 14 and 16 with the coils 15 and 17, from being built up.

The pulse duty factor of the thyristor 11 (the ratio of the total of the conducting intervals to the total elapsed time under consideration) determines the mean valve of the voltage at capacitor 16 and hence also the tube voltage. The ripple of this voltage is dependent upon the frequency with which the thyristor 11 is turned on and off, and upon the size of the capacitor 16. Each time an ignition pulse is supplied to the thyristor 11, the capacitor 16 is discharged, limited by the inductance 17, and the capacitor 14 of the LC-oscillatory circuit 14, 15, is discharged via the thyristor 11. The capacitor 14 recharges in the opposite sense to reverse its polarity and provide a forward voltage across the diode 13 and a counter-voltage to thyristor 11 so that the thyristor 11 is extinguished. The return oscillatory current thus flows through the free-running diode 13. The LC-oscillatory circuit can be dimensioned such that, within a very brief time after the end of an ignition pulse, the thyristor 11 is extinguished. The frequency of the ignition pulses supplied to the thyristor 11 can thus be selected to be very high. The ratio between the conductive and the blocking phase of the thyristor 11 determines the mean value of the voltage at the x-ray tube 1.

The rectifier 10 can in principle also be directly connected into the primary circuit of the high voltage transformer 4. The transformer-coupling via the transformer 6 is particularly desirable in the illustrated instance in which only a portion of the x-ray tube voltage must be adjusted, or regulated, respectively (i.e. to provide a fine adjustment, or fine regulation, respectively). The coarse adjustment proceeds in this instance via the input transformer 8. In the case of the transformer-coupling of the components 10 through 18 to the primary circuit and utilizing the permissible thyristor voltage, the currents in the control circuit including such components can be kept small.

The components 10 through 18, in the illustrated exemplary embodiment, form a regulator (or regulating unit) for the x-ray tube voltage. The respective x-ray tube voltage is adjustable at the control circuit 12 via the pulse duty factor of the thyristor 11. Within the scope of the invention, a closed-loop control (or regulation) of the x-ray tube voltage is also possible wherein there is connected with the input of the control circuit 12, a comparator for comparing the actual value and a nominal or setpoint value of the x-ray tube voltage, the output error signal from the comparator adjusting the control circuit so as to increase or decrease the duty cycle of thyristor 11 as needed to maintain the actual x-ray voltage value in correspondence with the setpoint value.

In the illustrated exemplary embodiment, it is possible to exchange the components 11 and 13 with 14. The sample embodiment represents a single phase x-ray diagnostic generator. Of course, the inventive idea is also applicable in the case of a three phase x-ray diagnostic generator. In this instance, in the case of transformer-coupling of components 11 through 18, it is possible to arrange, in the primary circuit of the three phase high voltage transformer, a three phase transformer with a three phase rectifier at the output of which the components 11 through 18 are connected.

By way of summary, it can be stated that the voltage at capacitor 16 is decisive for determining the x-ray tube voltage, the capacitor voltage is determined by the frequency of the partial discharges, and the degree to which each partial discharge is limited by the inductance 17; whereby the thyristor 11 is extinguished by the LC-oscillatory circuit 14, 15 (upon a first reversal of the polarity of the voltage across capacitor 14), and the free-running diode 13 is automatically extinguished (by a second reversal of polarity of the voltage across capacitor 14), after a brief time.

It will be apparent that many modifications and variations may be effected without departing from the scope of the novel concepts and teachings of the present invention.

We claim as our invention:

1. An x-ray diagnostic generator comprising a high voltage transformer with at least one primary winding connected to the mains, and at least one secondary winding which feeds the x-ray tube, comprising a bridge rectifier coupled with the primary circuit of the high voltage transformer, and having a smoothing capacitor and a thyristor connected with the bridge rectifier such that the turn-on frequency and pulse duty factor of the thyristor correspond to the desired x-ray tube voltage, characterized in that an LC-oscillatory circuit (14, 15) is connected to the thyristor (11), the LC-oscillatory circuit (14, 15) including a capacitor (14) which when the thyristor (11) is conductive, discharges itself via the thyristor, and said LC-oscillatory circuit having means comprising a free-running diode (13) connected in parallel with said thyristor (11) for effecting the extinction of the thyristor (11), the free-running diode (13) being conductive in the return oscillatory phase of the LC-oscillatory circuit.

2. An x-ray diagnostic generator according to claim 1, characterized in that a diode (18) and a limiting inductance (17) are connected between the smoothing capacitor (16) and thyristor (11), the diode (18) preventing a discharge of the capacitor (14) of the LC-oscillatory circuit (14, 15) into the smoothing capacitor (16).

* * * * *